US007698748B2

(12) United States Patent
Kim

(10) Patent No.: US 7,698,748 B2
(45) Date of Patent: Apr. 20, 2010

(54) REVERSIBLE NECKTIE AND METHOD FOR MAKING SAME

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 39 days.

(21) Appl. No.: 11/626,138

(22) Filed: Jan. 23, 2007

(65) Prior Publication Data

US 2008/0172772 A1 Jul. 24, 2008

(51) Int. Cl.
*A41D 25/00* (2006.01)

(52) U.S. Cl. ..... 2/144

(58) Field of Classification Search ..... 2/144–151, 2/152.1, 153–157; 24/49.1, 54, 65, 66.1
See application file for complete search history.

(56) References Cited

U.S. PATENT DOCUMENTS 3,264,654 A * 8/1966 Woronowicz et al. ..... 2/146
3,953,894 A * 5/1976 Aron ..... 2/146
3,959,825 A 6/1976 Hughes
5,575,007 A 11/1996 Gaffney
6,205,587 B1 3/2001 Shiffler
7,530,119 B1 * 5/2009 Jackson-Miller et al. ..... 2/144

* cited by examiner

*Primary Examiner*—Tejash Patel
(74) *Attorney, Agent, or Firm*—Leason Ellis LLP

(57) ABSTRACT

A reversible necktie according to one embodiment includes first and second fabric pieces that have matching necktie shapes. Each of the fabric pieces has a finished face side, a wide end, longitudinal edges and a narrow end. The fabric pieces are superimposed in mating relationship with the finished sides facing outward, wherein each of the first and second fabric pieces is formed of a first section that has a first appearance and a second section that has a second appearance that is visually different from the first appearance. The first and second sections are joined together along a seam. The first section of first fabric piece overlies the second section of the second fabric piece and the second section of the first fabric piece overlies the first section of the first fabric piece.

19 Claims, 12 Drawing Sheets

REVERSIBLE NECKTIE AND METHOD FOR MAKING SAME

TECHNICAL FIELD

The present invention relates generally to neckties, and more particularly, to reversible neckties which can be worn with either of two sides facing outward from the wearer, including a necktie in which the one side facing outward has two different patterns.

BACKGROUND

The most commonly used fibers for the manufacturing of neckties are silk, polyester, wool and wool blends, acetate, rayon, nylon, cotton, linen, and ramie. Neckties made from silk represent about 40 percent of the market. Raw silk is primarily imported from China and, to a far lesser extent, Brazil. Domestic weavers of tie fabrics buy their silk yarn in its natural state and have it finished and dyed by specialists. Technological advances have made possible the use of microfiber polyesters, which produce a rich, soft fabric resembling silk and which can be combined with natural or other artificial fibers to produce a wide range of effects.

The design of neckties is an interactive process between weavers and tie manufacturers. Because small quantities in any given pattern and color are produced, and because fabrics can be so complex, tie fabric weaving is seen as an art form by many in the industry.

The main components of a necktie are the outer fabric, or shell, the interlining (both cut on the bias), and the facing or tipping, which is stitched together by a resilient slip-stitch so that the finished tie can "give" while being tied and recover from constant knotting. The quality of the materials and construction determines if a tie will drape properly and hold its shape without wrinkling.

A well-cut lining is the essence of a good necktie. This interlining determines not only the shape of the tie but also how well it will wear. Therefore, it must be properly coordinated in blend, nap, and weight to the shell fabric. Lightweight outer material may require heavier interlining, while heavier outer fabrics need lighter interlining to give the necessary hand, drape, and recovery. Most interlining manufacturers use a marking system to identify the weight and content of their cloths, usually colored stripes, with one stripe being the lightest and six stripes being the heaviest.

It is also known in the art to have a reversible necktie having two sides or faces, each face being suitable for facing outward from the wearer. The materials used in the two sides of the necktie may be of different colors or different types of fabric or can have different imprinted patterns. Both sides are most commonly joined by together as by stitching and the necktie is everted to produce the reversible tie. As a result of this type of construction, some type of stitching is visible along the length of the necktie. This produces an unattractive appearance for the tie and therefore, there is a need for a method of fabricating a reversible necktie in which no visible line of stitching is present in the peripheral seam of the completed necktie.

In addition, there is also a need to provide a more fashionable necktie that includes two different sections providing two different appearances that can be visible when wearing the necktie.

SUMMARY

A reversible necktie according to one embodiment includes first and second fabric pieces that have matching necktie shapes. Each of the fabric pieces has a finished face side, a wide end, longitudinal edges and a narrow end. The fabric pieces are superimposed in mating relationship with the finished sides facing outward, wherein each of the first and second fabric pieces is formed of a first section that has a first appearance and a second section that has a second appearance that is visually different from the first appearance. The first and second sections are joined together along a seam. The first section of first fabric piece overlies the second section of the second fabric piece and the second section of the first fabric piece overlies the first section of the first fabric piece.

A method of manufacturing a reversible necktie includes the steps of: (a) providing a first fabric piece having a necktie shape and having a finished face side that has a first appearance, a wide end and a narrow end; (b) providing a second fabric piece having a necktie shape and having a finished face side that has a second appearance, a wide end and a narrow end; (c) superimposing the first fabric piece on the second fabric with the wide ends being at one end and the narrow ends at the other end and the finished face sides facing one another; (d) forming an interlining layer having a necktie shape having a wide end and a narrow end and a layer of second material that has a necktie shape and includes a wide end and narrow end, the layer of second material having dimensions greater than dimensions of the interlining layer; (e) superimposing the interlining layer on the layer of second material such that both wide ends are near one another and attaching the interlining layer to the layer of second material to form a first layered structure; (f) superimposing the first layered structure on the superimposed first and second fabric pieces with the layer of second material being in contact with and overlying the first fabric piece; (g) attaching the layer of second material to the superimposed first and second fabric pieces such that the interlining layer remains free and unattached to the first and second fabric pieces to form a second layered structure; and (h) everting the second layered structure so that the first and second finished sides face outward.

In one embodiment, each of the first and second fabric pieces is formed of a first section that has a first appearance and a second section that has a second appearance that is visually different from the first appearance. The first and second sections are joined together along a seam and the first section of first fabric piece overlies the second section of the second fabric piece and the second section of the first fabric piece overlies the first section of the first fabric piece both in the first layered structure and the second layered structure.

BRIEF DESCRIPTION OF THE DRAWING FIGURES

DETAILED DESCRIPTION OF PREFERRED EMBODIMENTS

Figure 1A:
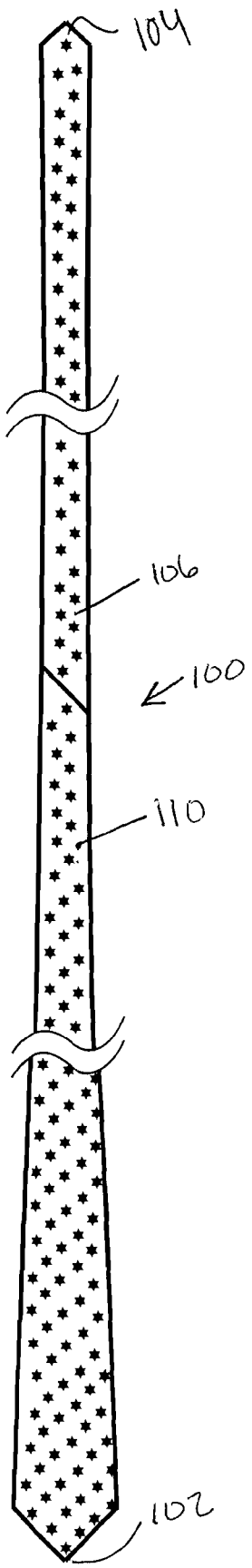
FIG. 1A is a front elevation view of a first side of a necktie according to one exemplary embodiment.
Figure 1B:
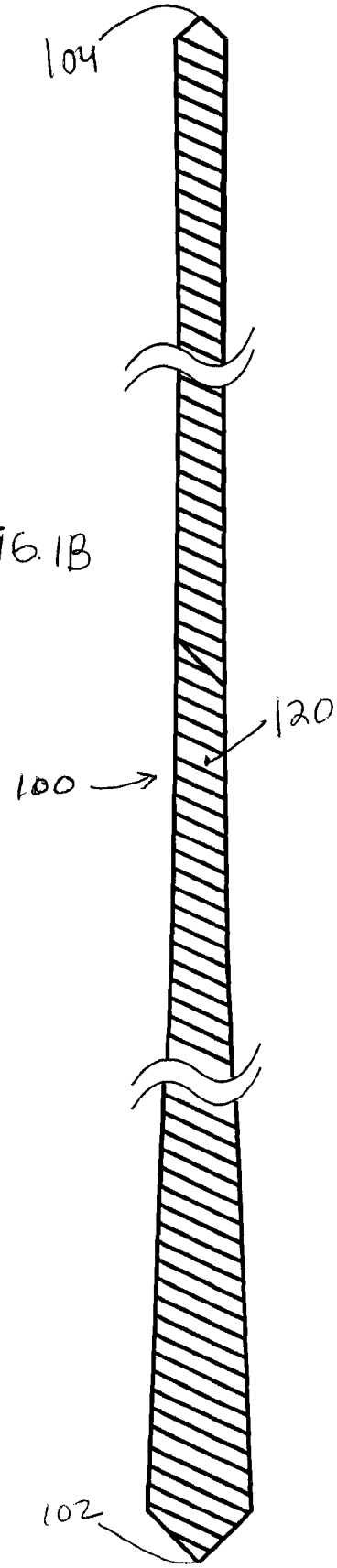
FIG. 1B is a rear elevation view of a second side of the necktie of FIG. 1A.

Referring first to FIGS. 1A and 1B, a necktie 100 according to one embodiment is illustrated. The necktie 100 is generally in the form of a long strip of material that has a first pointed end 102 that is worn near the wearer's belt or waist line and an opposite second pointed end 104 that is narrower than the first pointed end 102. Between the first and second pointed ends 102, 104 is a narrow neck band 106. The necktie 100 has a first side 110 and a second side 120 connected opposite the first side 110. Sides 110, 120 are preferably symmetric in that they have the same contours and dimensions.

In accordance with the first embodiment of the present invention, the materials used in the first side 110 and the second side 120 of the necktie 100 can be of different colors or different types of fabric or can have different imprinted patterns. In other words, the first side 110 has a different appearance from the second side 120, with either the first side 110 or the second side 120 being wearable facing outward from the wearer. In the illustrated embodiment, the first side 110 has a first appearance, such as stars or polka dots, and the second side 120 has a second appearance, such as a stripped pattern.

The colors of the first and second sides 110, 120 can be complementary in that the colors can be the same or similar colors or they can be different but complementary colors. Alternatively, the colors of the first side 110 can be in contrast to the colors of the second side 120. This provides the wearer with two tie options that are visually much different, such as one side being a bright red color and pattern and the opposite side being a blue color and pattern.

In the first embodiment, the first side 110 has the same pattern from the first pointed end 102 to the second pointed end 104 and similarly, the second side 120 has the same pattern from the first pointed end 102 to the second pointed end 104.

The necktie 100 is worn like any other conventional tie and in particular and as is commonly done, the necktie 100 is worn as a four-in-hand necktie. When the necktie 100 is tied around the neck of a wearer, the necktie 100 is positioned around the neck and is tied so that either the first or second sides 110, 120 face outwardly from the wearer. As is know, when the necktie 100 is tied around the wearer's neck, a first section that contains the second pointed end 103 lies underneath a second section that contains the first pointed in such a manner that both outer surfaces of the two sections are the same and product the same visual appearance. In the event that the underling fist section becomes displaced from its position under the second section, the outer appearance of the necktie 100 is still satisfactory since the visible surfaces of the necktie 100 is the same.

Figure 2A:
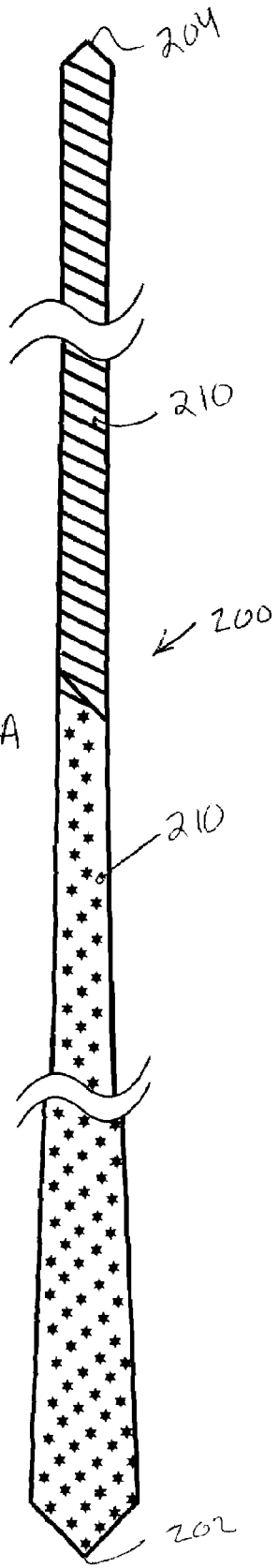
FIG. 2A is a front elevation view of a first side of a necktie according to another exemplary embodiment.
Figure 2B:
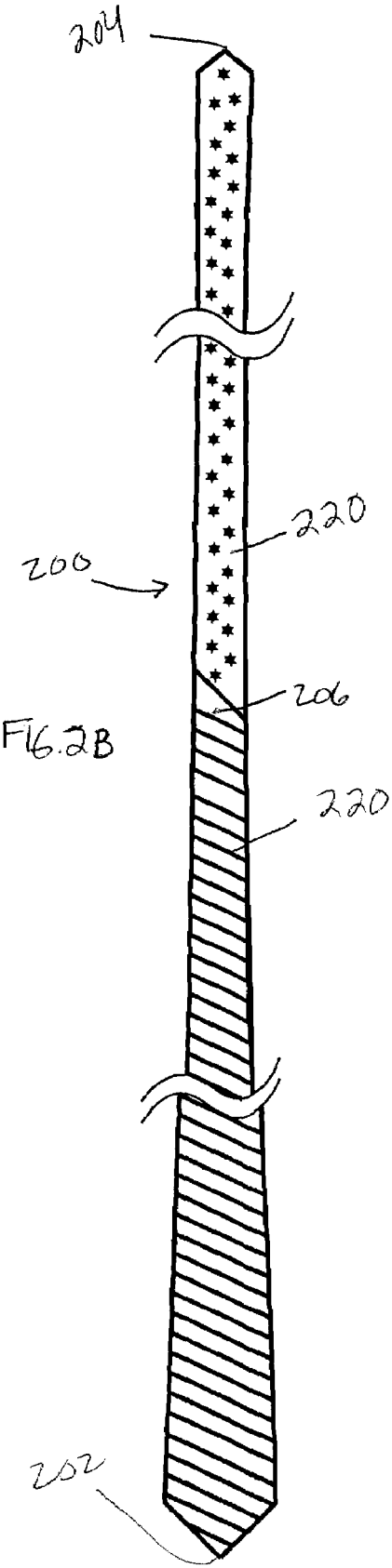
FIG. 2B is a rear elevation view of a second side of the necktie of FIG. 2A.

Referring first to FIGS. 2A and 2B, a necktie 200 according to one embodiment is illustrated. The necktie 200 is generally in the form of a long strip of material that has a first pointed end 202 that is worn near the wearer's belt or waist line and an opposite second pointed end 204 that is narrower than the first pointed end 202. Between the first and second pointed ends 202, 204 is a narrow neck band 206. The necktie 200 has a first side 210 and a second side 220 connected opposite the first side 210. Sides 210, 220 are preferably symmetric in that they have the same contours and dimensions.

In accordance with the second embodiment of the present invention, the materials used in the first side 210 and the second side 220 of the necktie 200 can be of different colors or different types of fabric or can have different imprinted patterns. In other words, the first side 210 has a different appearance from the second side 220, with either the first side 210 or the second side 220 being wearable facing outward from the wearer. In the illustrated embodiment, a main display region of the first side 210 has a first appearance, such as polka dots or stars, and a main display region the second side 220 has a second appearance, such as a stripped pattern.

The colors of the first and second sides 210, 220 can be complementary in that the colors can be the same or similar colors or they can be different but complementary colors. Alternatively, the colors of the first side 210 can be in contrast to the colors of the second side 220. This provides the wearer with two tie options that are visually much different, such as one side being a bright red color and pattern and the opposite side being a blue color and pattern.

Unlike, the first embodiment, in the second embodiment, the first side 210 does not have the same pattern from the first pointed end 202 to the second pointed end 204 and similarly, the second side 220 does not has the same pattern from the first pointed end 202 to the second pointed end 204.

According to the second embodiment, the first side 210 has two distinct sections that contain two different patterns and similarly, the second side 220 has two distinct sections that contain two different patterns. For example, the first side 210 includes an end section that includes the first pointed end 202 and a tail section that includes the second pointed end 204 with a line that divides the two sections being formed in the narrow neck band 206.

The line can be a diagonal line relative to the longitudinal edges of the tie 200 or it can a straight line perpendicular to the longitudinal edges.

The necktie 200 is worn like any other conventional tie and in particular and as is commonly done, the necktie 200 is worn as a four-in-hand necktie. When the necktie 100 is tied around the neck of a wearer, the necktie 200 is positioned around the neck and is tied so that either the end section of the first or second side 110, 120 faces outwardly from the wearer. As is know, when the necktie 100 is tied around the wearer's neck, the tail section that contains the second pointed end 204 lies underneath the end section that contains the first pointed end 202; however and in contrast to the first embodiment in FIGS. 1A and 1B, the visible outer surface of the tail section that underlies the end section does not have the same pattern as the visible outer surface of the end section. In other words and when viewed by another, the tail section under the end section provides a different visual appearance than the outwardly visible end section.

Figure 3:
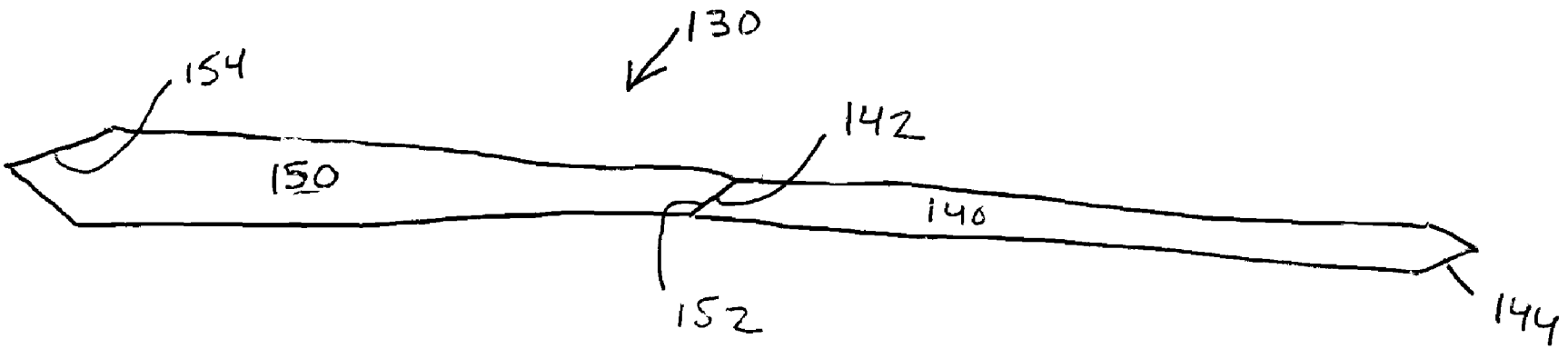
FIG. 3 is front elevation view of two pieces that form an interlining that is part of the necktie of FIGS. 1A and 1B, wherein the two interlining pieces are joined together.

The manufacture of the necktie 100 according to the first embodiment is described with reference to FIGS. 3-9. An interlining 130 is provided and includes two sections, namely, a first section 140 (which can also be referred to as a tie tail portion) and a second section 150 (which can also be referred to as an end portion of the tie). As with conventional neckties, the interlining 130 is cut in the shape of the necktie 100 itself. As shown in FIG. 3, the first section 140 includes a first end 142 that is defined by a cut line (e.g., diagonal line) and an opposite second end 144 in the form of a pointed end. The second section 150 includes a first end 152 that is defined by a cut line (e.g., a diagonal line) and a second end 154 in the form of a pointed end.

As shown in FIG. 3, the first and second sections 140, 150 are joined together by arranging the first ends 142, 152 adjacent (abutting) one another so that the pointed ends 144, 154 define the two ends of the elongated interlining structure. When positioning the two first ends 142, 152, the ends are fitted that the diagonal ends compliment each other and the width of the interlining 130 is uniform in this region as shown in FIG. 3. The manner of attaching the first ends 142, 152 can be any number of conventional techniques, including stitching or tacking, the two sections 140, 150 together.

It will also be appreciated that instead of being formed in two different sections, the interlining 130 can be formed of a single structure that can be cut from a piece of material that forms the interlining 130.

The interlining 130 is formed of traditional necktie interlining materials.

Figure 4:
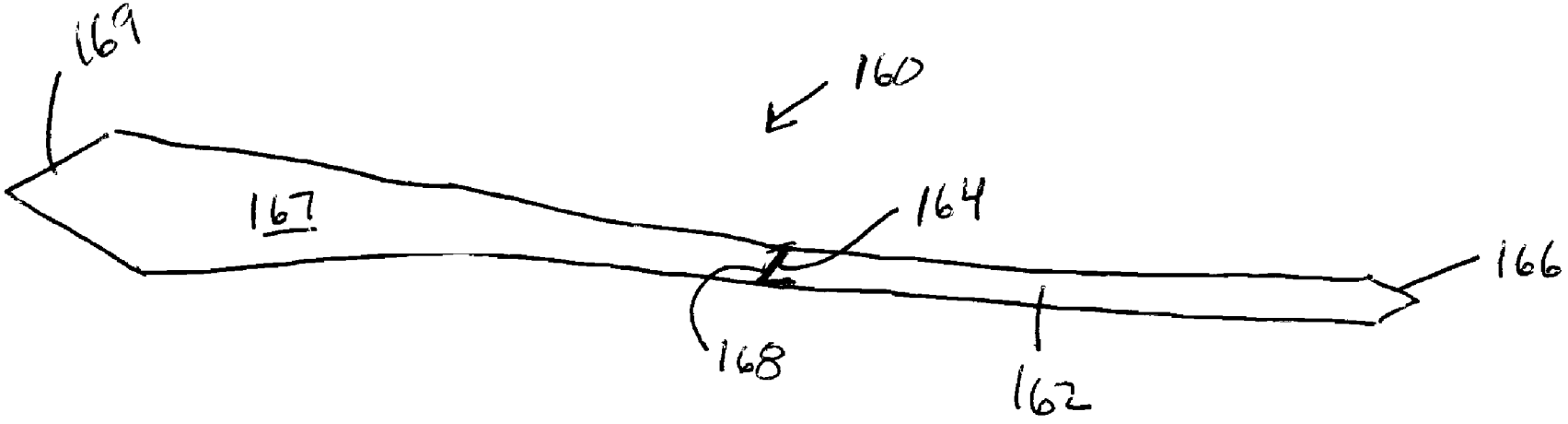
FIG. 4 is front elevation view of two pieces that form a thin layer that is part of the necktie of FIGS. 1A and 1B, wherein the two thin layer pieces are joined together.

The next step is to prepare a thin, flexible layer 160 that similar to the interlining 130 has a shape of the necktie 100 as illustrated in FIG. 4. The layer 160 has greater dimensions (length and width) relative to the interlining 130. Similar to the interlining 130, the layer 160 can be formed of two sections, namely, a first section 162 (which can also be referred to as a tie tail portion) and a second section 167 (which can also be referred to as an end portion of the tie). The layer 160 is cut in the shape of the necktie 100 itself. As shown in FIG. 4, the first section 162 includes a first end 164 that is defined by a cut line (e.g., diagonal line) and an opposite second end 166 in the form of a pointed end. The second section 167 includes a first end 168 that is defined by a cut line (e.g., a diagonal line) and a second end 169 in the form of a pointed end.

As shown in FIG. 4, the first and second sections 162, 167 are joined together by arranging the first ends 164, 168 adjacent (abutting) one another so that the pointed ends 166, 169 define the two ends of the elongated interlining structure. When positioning the two first ends 164, 168, the ends are fitted that the diagonal ends compliment each other and the width of the layer 160 is uniform in this region as shown in FIG. 4. The manner of attaching the first ends 164, 168 can be any number of conventional techniques, including stitching the two sections 162, 167 together.

The layer 160 can be formed of any number of different materials so long as the layer 160 is a thin layer. For example, the layer 160 can be formed of a paper material or it can be formed of a synthetic material, such as a thin plastic mesh, both of which can easily be cut.

Figure 5:
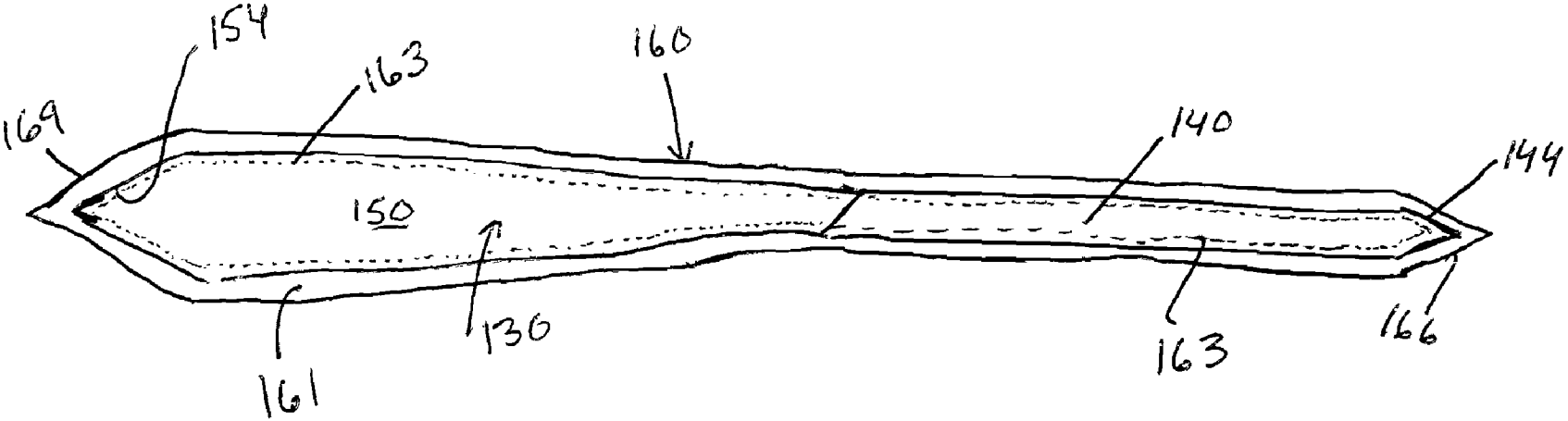
FIG. 5 is a front elevation view of the interlining laid over and attached to the thin layer.

Now referring to FIG. 5 in which the interlining 130 is disposed and laid over the layer 160 such that the pointed end 144 is proximate and aligned with the pointed end 166 and the pointed end 154 is proximate and aligned with the pointed end 169. As shown in FIG. 5, the greater dimensions of the layer 160 compared to the interlining 130 causes an outer peripheral strip section 161 to be formed around the peripheral edge of the interlining 130. The interlining 130 is then attached to the layer 160 using traditional techniques, including using stitching or the like (indicated at 163).

Figure 6:
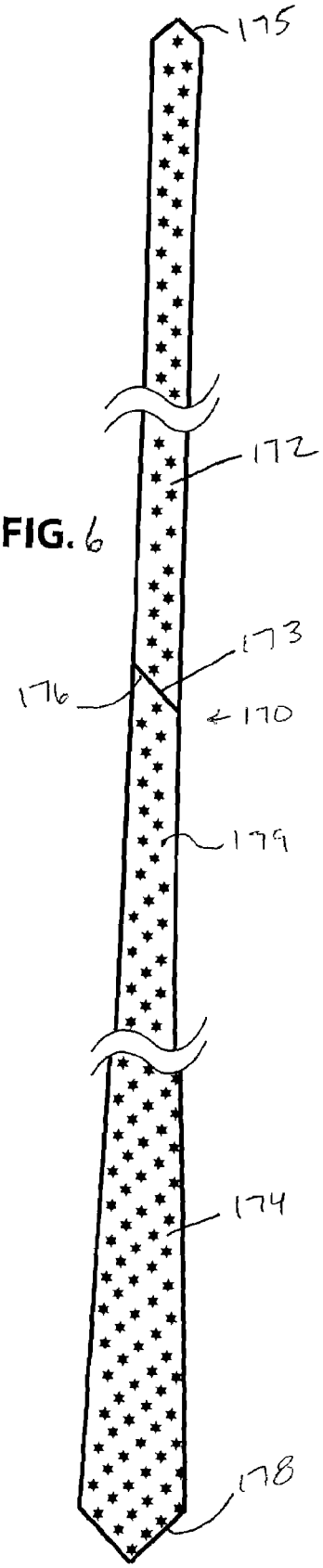
FIG. 6 is a front elevation view of first and second fabric pieces joined together to form a first side of the necktie of FIGS. 1A and 1B.
Figure 7:
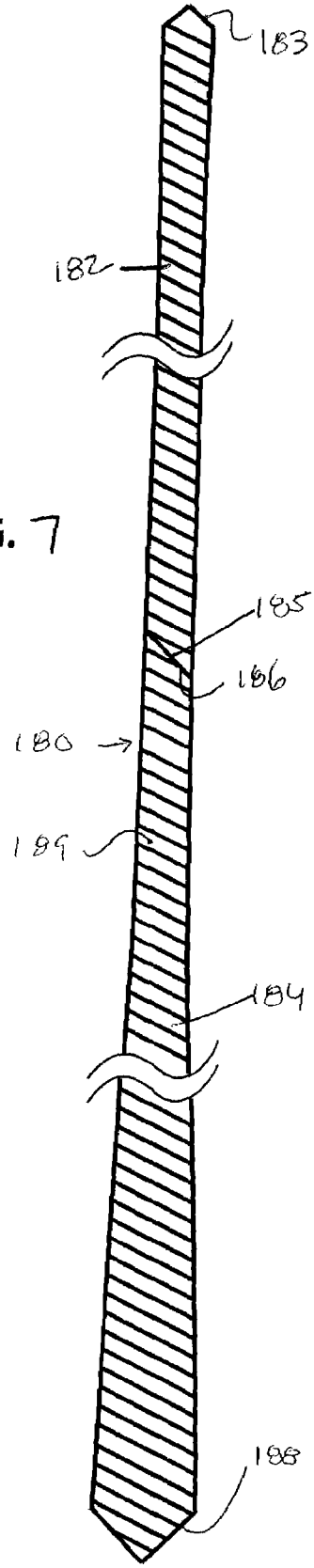
FIG. 7 is a front elevation view of first and second fabric pieces joined together to form a second side of the necktie of FIGS. 1A and 1B.

As shown in FIGS. 6-7, the next step is to form two tie swatches that ultimately form the first and second sides 110, 120, respectively. More specifically, a first swatch 170 has a shape similar to the completed necktie 100 as illustrated in FIG. 6. The first swatch 170 represents and defines the first side 110 of the necktie 100. Similar to the other components, the first swatch 170 can be formed of two sections, namely, a first section 172 (which can also be referred to as a tie tail portion) and a second section 174 (which can also be referred to as an end portion of the tie). The first swatch 170 is cut in the shape of the necktie 100 itself. As shown in FIG. 6, the first section 172 includes a first end 173 that is defined by a cut line (e.g., diagonal line) and an opposite second end 175 in the form of a pointed end. The second section 174 includes a first end 176 that is defined by a cut line (e.g., a diagonal line) and a second end 178 in the form of a pointed end. The first swatch 170 has an inner side or surface and an opposite outer side or surface 179 that represents the first side 110 of the necktie 100.

More specifically, a second swatch 180 has a shape similar to the completed necktie 100 as illustrated in FIG. 7. The second swatch 180 represents and defines the second side 120 of the necktie 100. Similar to the other components, the second swatch 180 can be formed of two sections, namely, a first section 182 (which can also be referred to as a tie tail portion) and a second section 184 (which can also be referred to as an end portion of the tie). The second swatch 180 is cut in the shape of the necktie 100 itself. As shown in FIG. 7, the first section 182 includes a first end 183 that is defined by a cut line (e.g., diagonal line) and an opposite second end 185 in the form of a pointed end. The second section 184 includes a first end 186 that is defined by a cut line (e.g., a diagonal line) and a second end 188 in the form of a pointed end. The second swatch 180 has an inner side or surface and an opposite outer side or surface 189 that represents the second side 120 of the necktie 100.

As shown in FIG. 6, the first and second sections 172, 174 are joined together by arranging the first ends 173, 176 adjacent (abutting) one another so that the pointed ends 175, 178 define the two ends of the elongated interlining structure. When positioning the two first ends 173, 176, the ends are fitted that the diagonal ends complement each other and the width of the first swatch 170 is uniform in this region as shown in FIG. 6. The manner of attaching the first ends 173, 176 can be any number of conventional techniques, including stitching (sewing) the two sections 172, 174 together. Similarly, the second swatch 180 is attached in the same manner the first swatch 170 is attached as shown in FIG. 7. In particular, the first and second sections 182, 184 are joined together by arranging the first ends 183, 186 adjacent (abutting) one another so that the pointed ends 185, 188 define the two ends of the elongated interlining structure. When positioning the two first ends 183, 186, the ends are fitted that the diagonal ends complement each other and the width of the second swatch 180 is uniform in this region as shown in FIG. 7. The manner of attaching the first ends 183, 186 can be any number of conventional techniques, including stitching (sewing) the two sections 182, 184 together.

Figure 8:
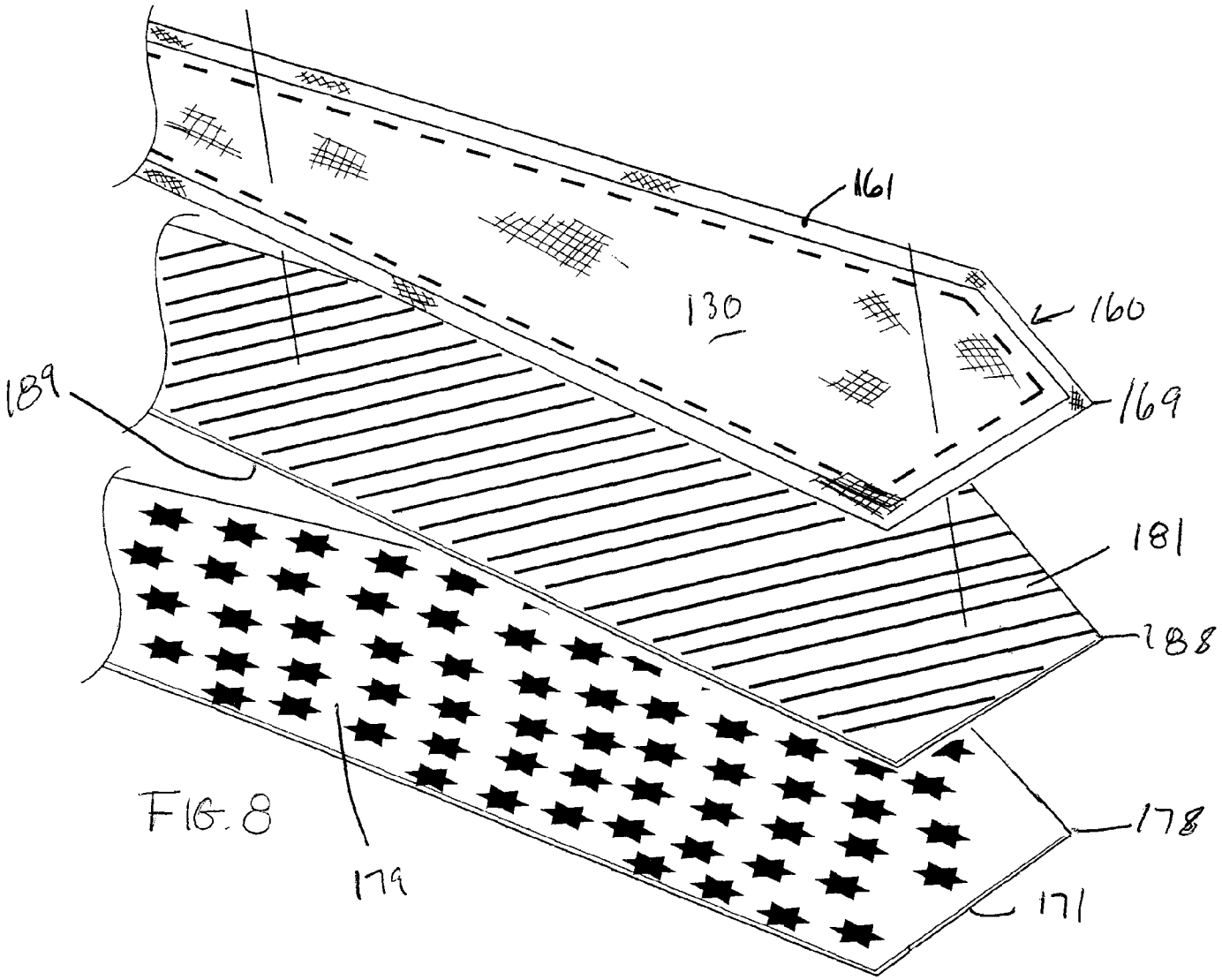
FIG. 8 is an exploded perspective view the attached structure of FIG. 5 laid over the fabric piece of the first side of the necktie which is itself laid over the fabric piece of the second side of the necktie.

As shown in FIG. 8, the first and second swatches 170, 180 are laid over one another so that outer surfaces (faces) 179, 189 thereof face another, with the inner surfaces 171, 181 facing outward and away from one another. In aligning the swatches 170, 180, the pointed ends 175, 185 lie over one another and the pointed ends 178, 188 lie over one another. It will be appreciated that while FIG. 8 shows the second swatch lying over the first swatch, the opposite arrangement is equally possible and yields the same result.

Figure 9:
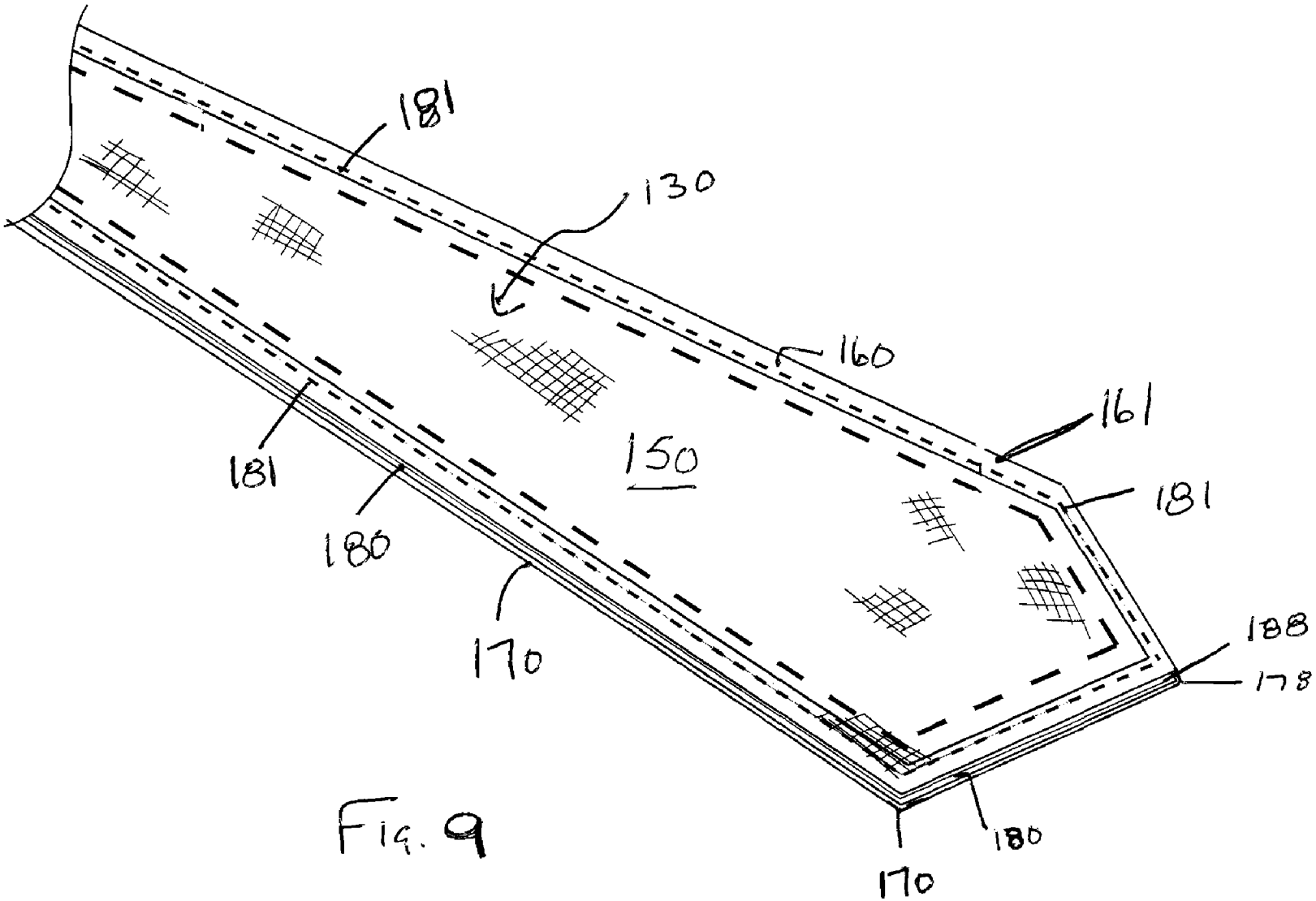
FIG. 9 is a perspective view of the layers of FIG. 8 with the attached structure of FIG. 5 attached to the fabric pieces defining the first and second sides of the necktie.

As shown in FIGS. 8 and 9, next the attached layer 160 and interlining 130 structure is laid over the combined first and second swatches 170, 180 to form a layered structure defined by the two swatches 170, 180, layer 160 and interlining 130. The layer 160 is laid over and in contact with the inner surface 181 of the second swatch 180, with the pointed end 166 overlying the pointed end 185 and the pointed end 169 overlying the pointed end 188. The interlining 130 represents one outer layer of the layered structure.

The layer 160 is then attached to the first and second swatches 170, 180 as shown in FIG. 9 by attaching the outer peripheral strip section 161 to the layered swatches 170, 180. For example, the outer peripheral strip section 161 is stitched (sewn) to the layered first and second swatches 170, 180. The stitching, generally indicated at 181, is positioned close to but not in contact with the interlining 130 and therefore, the interlining is not directly stitched to the swatches 170, 180. This space that is left between the interlining 130 and the stitching ensure that the interlining 130 is not sewn and therefore, the entire layered structure of FIG. 9 can be everted (flipped over) as discussed below. It will be understood that the attached structure formed by the interlining 130 and thin layer 160 can equally be attached to the inner surface 171 of the first swatch which is arranged such that its outer surface 179 faces the outer surface 189 of the second swatch.

The eversion of the necktie 100 completes the fabrication process. The wider pointed ends 178, 188, of the swatches 170, 180 can be urged into the internal space or cavity formed between the two swatches 170, 180 and by means of an everting tool, such as a rod having a blunt end. The everting process continues and is completed when the necktie 100 is fully everted resulting in necktie 100 that is free of any side seams. Instead, the stitch lines are located inside the necktie 100 resulting in a visually pleasing article where the outer surfaces 179, 189 face outwardly on the two respective sides.

FIG. 1A shows the first side 110 of the necktie 100 after it has been everted and FIG. 1B shows the second side 120 after the necktie 100 has been everted.

The manufacture of the necktie 200 according to the second embodiment is described with reference to FIGS. 10-14. The interlining 130 is provided and includes two sections, namely, the first section 140 (which can also be referred to as a tie tail portion) and a second section 150 (which can also be referred to as an end portion of the tie). As with conventional neckties, the interlining 130 is cut in the shape of the necktie 100 itself and it includes the same structure as shown in FIG. 3 and therefore, will not be described in detail again.

The next step is to prepare the thin, flexible layer 160 that similar to the interlining 130 has a shape of the necktie 100 as illustrated in FIG. 4. Once again, the layer 160 has already been described with reference to FIG. 4 and therefore will not be described in great detail again.

Now referring to FIG. 5 in which the interlining 130 is disposed and laid over the layer 160 such that the pointed end 144 is proximate and aligned with the pointed end 166 and the pointed end 154 is proximate and aligned with the pointed end 169. The interlining 130 is then attached to the layer 160 using traditional techniques, including using stitching 163 or the like.

Figure 10:
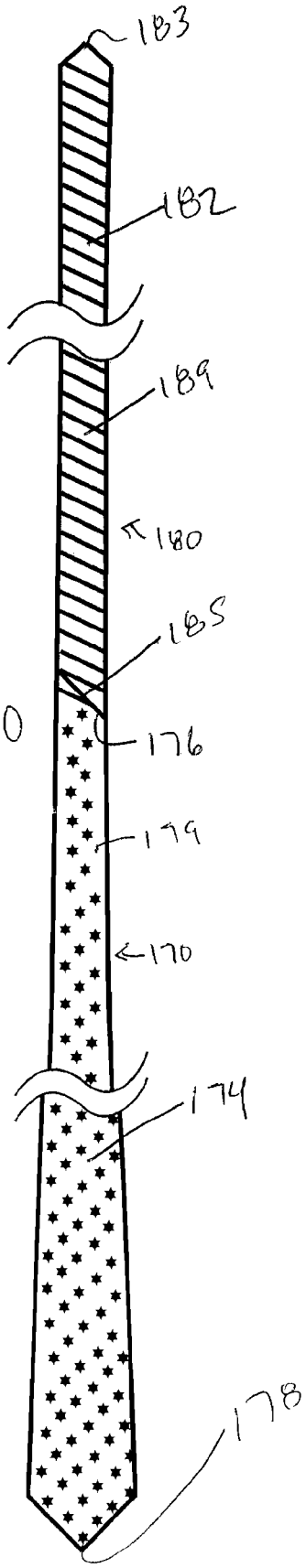
FIG. 10 is a front elevation view of first and second fabric pieces joined together to form a first side of the necktie of FIGS. 2A and 2B.
Figure 11:
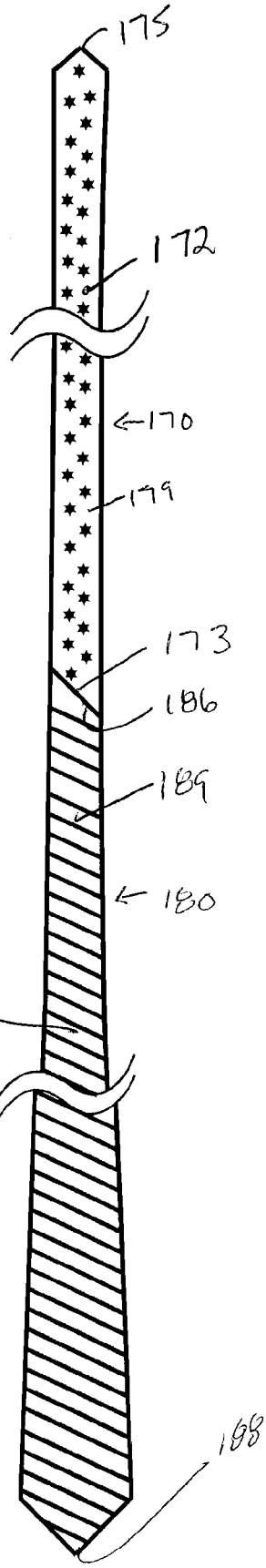
FIG. 11 is a front elevation view of first and second fabric pieces joined together to form a second side of the necktie of FIGS. 2A and 2B.

As shown in FIGS. 10-11, the next step is to form two tie swatches that ultimately form the first and second sides 210, 220, respectively. More specifically, the first swatch 170 is formed of two sections, namely, a first section 172 (which can also be referred to as a tie tail portion) and a second section 174 (which can also be referred to as an end portion of the tie). The first swatch 170 is cut in the shape of the necktie 100 itself. As shown in FIG. 20, the first section 172 includes a first end 173 that is defined by a cut line (e.g., diagonal line) and an opposite second end 175 in the form of a pointed end. The second section 174 includes a first end 176 that is defined by a cut line (e.g., a diagonal line) and a second end 178 in the form of a pointed end. The first swatch 170 has an inner side or surface 171 and an opposite outer side or surface 179 that represents the first side 110 of the necktie 100.

More specifically and as shown in FIGS. 10-11, the second swatch 180 is formed of two sections, namely, a first section 182 (which can also be referred to as a tie tail portion) and a second section 184 (which can also be referred to as an end portion of the tie). The second swatch 180 is cut in the shape of the necktie 100 itself. As shown in FIG. 20, the first section 182 includes a first end 183 that is defined by a cut line (e.g., diagonal line) and an opposite second end 185 in the form of a pointed end. The second section 184 includes a first end 186 that is defined by a cut line (e.g., a diagonal line) and a second end 188 in the form of a pointed end. The second swatch 180 has an inner side or surface 181 and an opposite outer side or surface 189 that represents the second side 120 of the necktie 100.

Unlike the first embodiment, both sections of the swatch 170 do not form one complete side of the necktie 200 and similarly, both sections of the swatch 180 do not form one complete side of the necktie 200. In contrast, the first section 172 of the first swatch 170 is joined to the second section 184 as shown in FIG. 11 by arranging the first ends 173, 186 adjacent (abutting) one another so that the pointed ends 175, 188 define the two ends of the elongated interlining structure. The manner of attaching the first ends 173, 186 can be any number of conventional techniques, including stitching (sewing) the two sections 172, 184 together.

Similarly, the first and second sections 182, 174 are joined together by arranging the first ends 183, 176 adjacent (abutting) one another so that the pointed ends 185, 178 define the two ends of the elongated interlining structure as shown in FIG. 10. When positioning the two first ends 183, 176, the ends are fitted that the diagonal ends complement each other. The manner of attaching the first ends 183, 176 can be any number of conventional techniques, including stitching (sewing) the two sections 182, 174 together.

The result is that each of the first and second sides 210, 220 is defined by a combination of two different swatches so that each side is not uniform along its entire length. In particular, the first side 210 is defined by the first section 172 of the first swatch 170 and the second section 184 of the second swatch 180 and the second side 220 is defined by the first section 182 of the second swatch 180 and the second section 174 of the first swatch 170.

Figure 12:
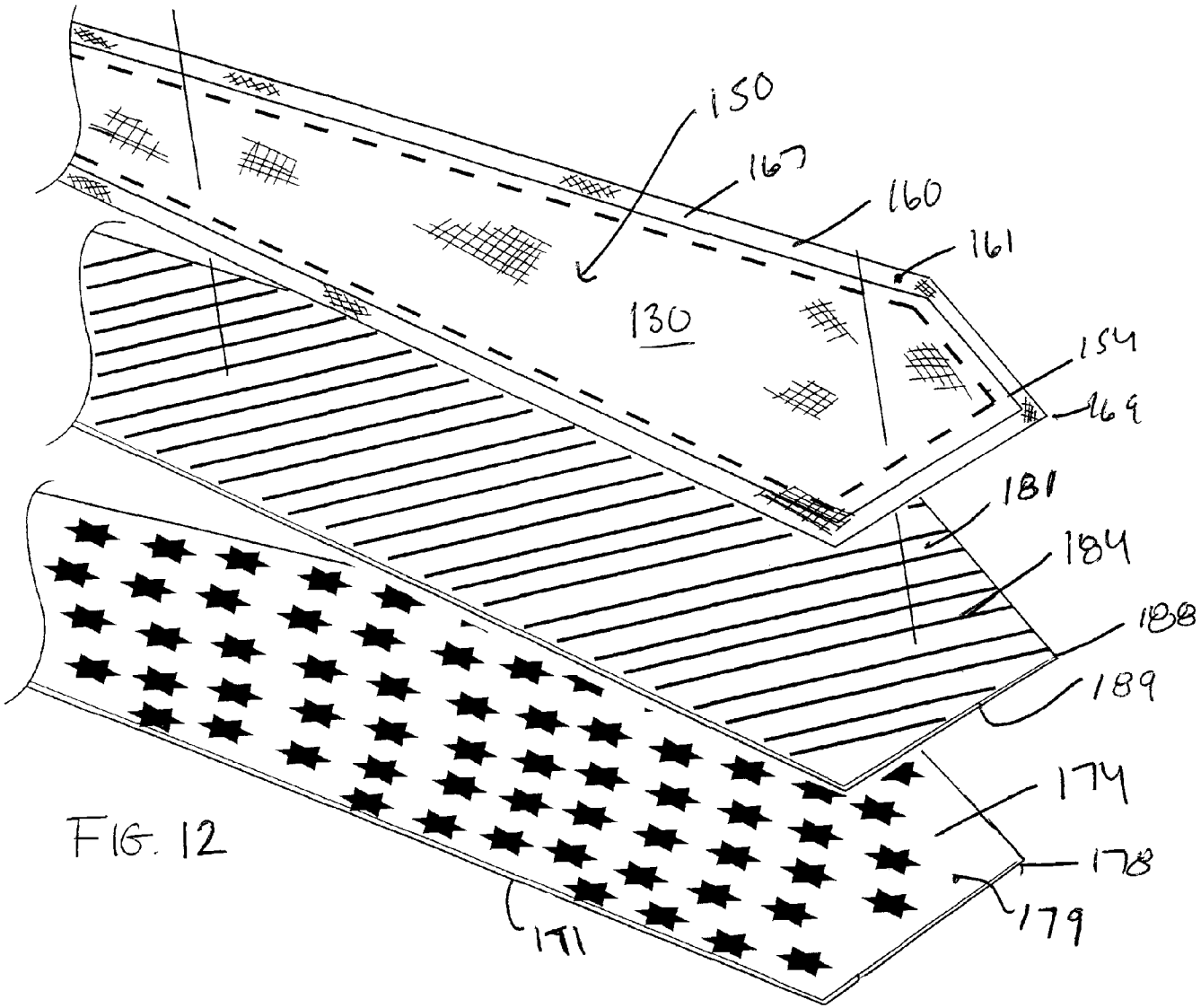
FIG. 12 is an exploded perspective view the attached structure of FIG. 5 laid over a second fabric piece of the first side of the necktie which is itself laid over a fourth fabric piece of the second side of the necktie.

As shown in FIG. 12, the combined first section 172 and second section 184 is laid over the combined first section 182 and second section 174 so that the outer surfaces 189, 179

(faces) thereof face another, with the inner surfaces 181, 171 facing outward and away from one another. In aligning the these combined swatches, the pointed ends 175, 185 lie over one another and the pointed ends 178, 188 lie over one another.

Figure 13:
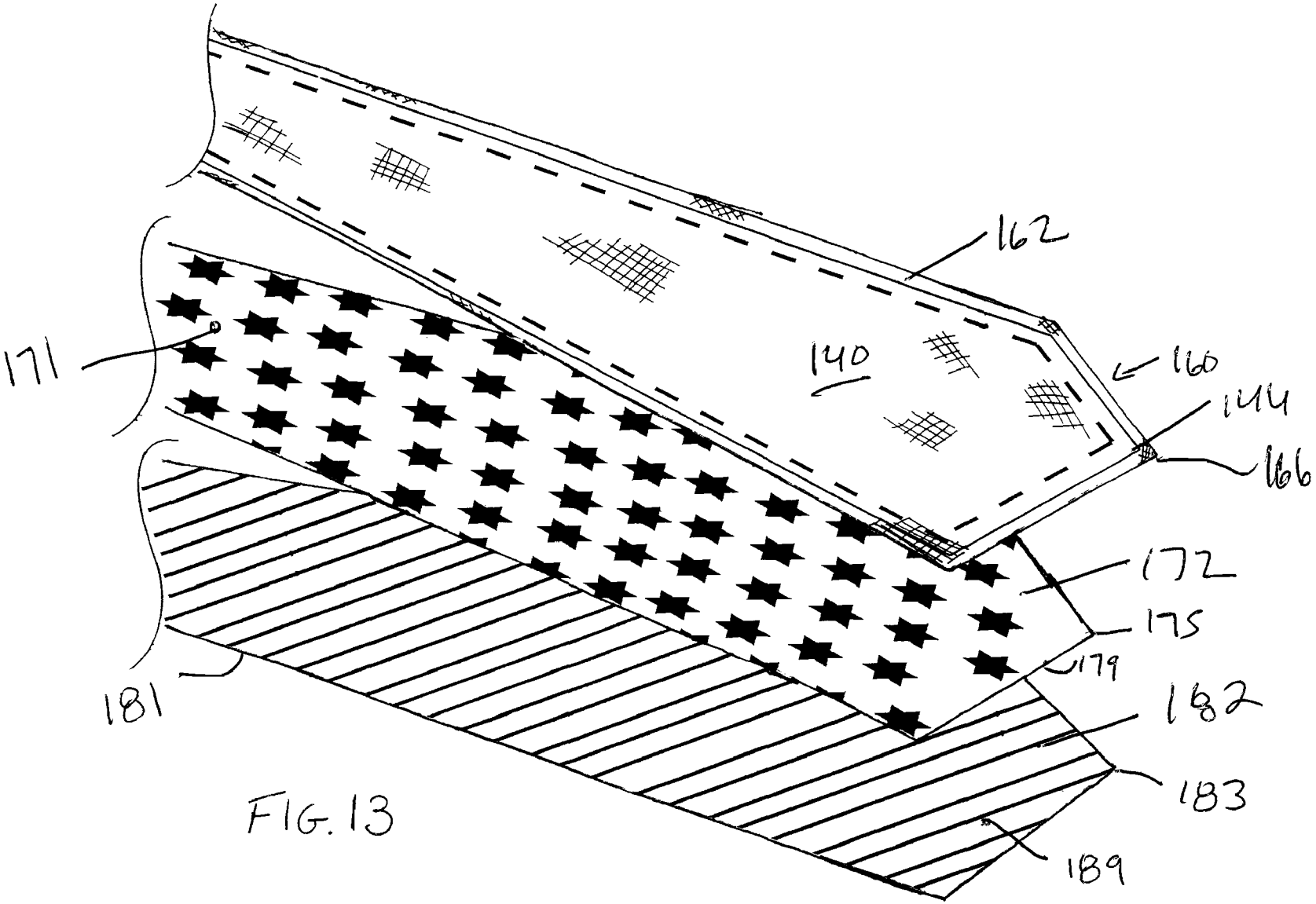
FIG. 13 is an exploded perspective view the attached structure of FIG. 5 laid over a first fabric piece of the first side of the necktie which is itself laid over a third fabric piece of the second side of the necktie.

As shown in FIGS. 12-13, next the attached layer 160 and interlining 130 is laid over the attached first section 172 and second section 184 and the attached first section 182 and second section 174 to form a layered structure defined by the sections of the two swatches 170, 180, the layer 160 and the interlining 130. The layer 160 is laid over and in contact with the inner surface (171, 181, respectively) of the joined first section 172 and second section 184, with the pointed end 166 overlying the pointed end 175 and the pointed end 169 overlying the pointed end 188. The interlining 130 represents one outer layer of the layered structure.

Figure 14:
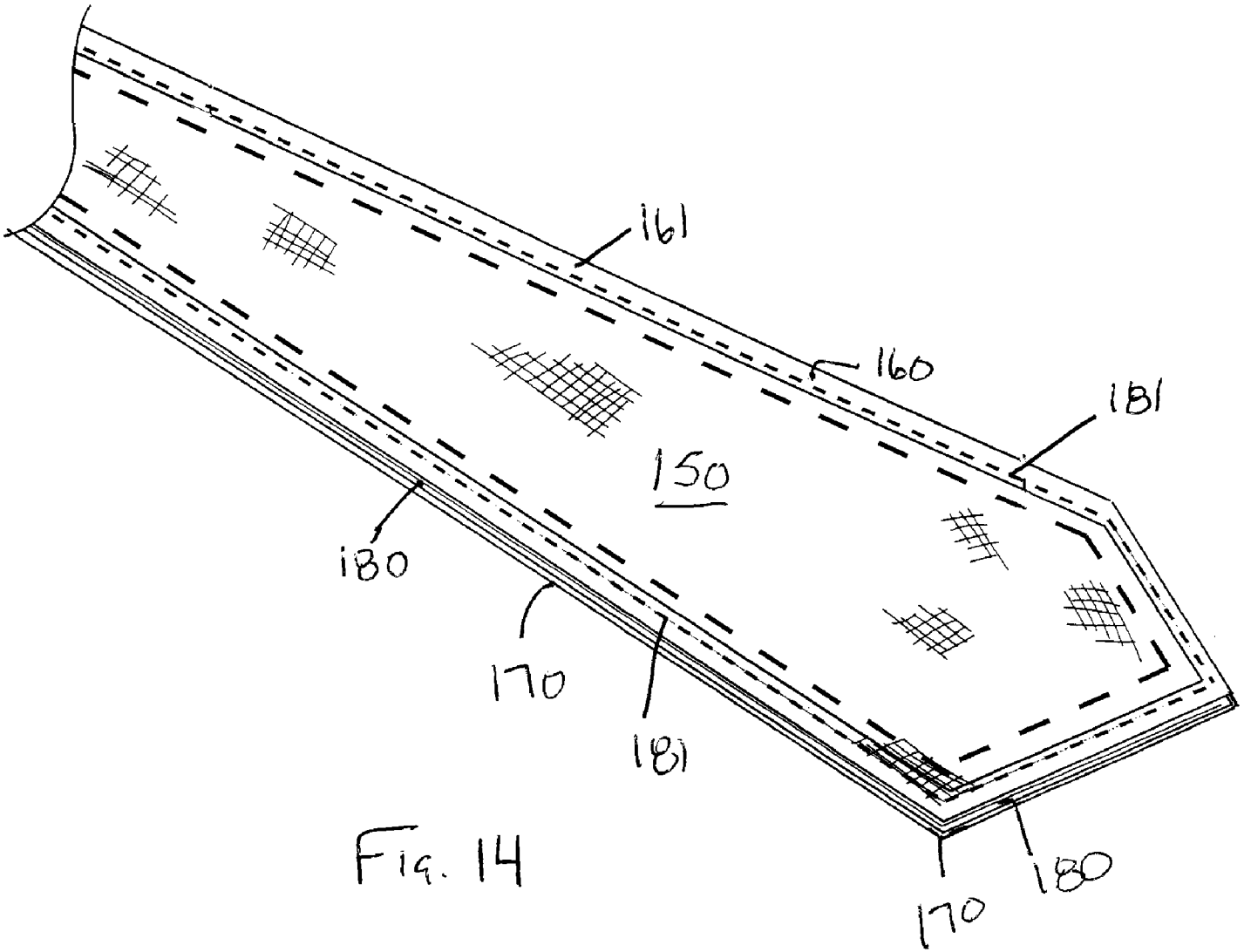
FIG. 14 is a perspective view of the layers of FIG. 12 with the attached structure of FIG. 5 attached to the fabric pieces defining the first and second sides of the necktie.

The layer 160 is then attached to the layered first section 172 and second section 184 and the attached first section 182 and second section 174 as shown in FIGS. 12-14 by attaching the outer peripheral strip section 161 to the layered swatches using stitches 181. For example, the outer peripheral strip section 161 is stitched (sewn) to the layered first and second swatches. The stitching 181 is positioned close to but not in contact with the interlining 130 and therefore, the interlining is not directly stitched to the parts of the swatches 170, 180. This space that is left between the interlining 130 and the stitching ensure that the interlining 130 is not sewn and therefore, the entire layered structure of FIG. 14 can be everted (flipped over) as discussed below.

The eversion of the necktie 200 completes the fabrication process as described above.

FIG. 2A shows the first side 210 of the necktie 200 and FIG. 2B shows the second side 220.

It will be appreciated that the necktie 200 offers a much different appearance and provides a much different fashion statement in that when the necktie 200 is tied in a typical four in hand knot, the outermost tie section with the wider pointed end has a first appearance on the surface facing outward which is visible to people and the underling tail portion of the necktie that is narrow and includes the narrower pointed end has a second appearance on its surface that faces outward and is visible to people. Thus, two different patterns will be visible when the underlying tail portion becomes misplaced from the outermost tie section. Depending upon the contrast and the differences in the patterns and colors, etc., the two different sections can either be in slight contrast or in significant contrast with one another. For example, the overlying portion can be a bright green pattern and the underlying portion can be a yellow pattern. Similarly, the patterns themselves can be much different and provide contrast with one another.

It will be appreciated by persons skilled in the art that the present invention is not limited to the embodiments described thus far with reference to the accompanying drawings; rather the present invention is limited only by the following claims.

What is claimed is:

1. A reversible necktie comprising:

first and second fabric pieces that have matching necktie shapes, each of the fabric pieces having a finished face side, a wide end, longitudinal edges and a narrow end, the first and second fabric pieces defining the two face layers of the tie and being superimposed in mating relationship with the finished sides thereof facing outward, wherein each of the first and second fabric pieces is formed of a first section that has a first appearance due to a look of a printed pattern on material that forms the first section and a second section that has a second appearance due to a look of a printed pattern on material that forms the second section, the second appearance being visually different from the first appearance, the first and second sections being joined together along a seam such that the first section includes the wide end and the second section includes the narrow end, the first section of first fabric piece overlying the second section of the second fabric piece and the second section of the first fabric piece overlying the first section of the first fabric piece resulting in the wide end of the first fabric piece having the same printed pattern as the narrow end of the second fabric piece.

2. The reversible necktie of claim 1, wherein the first appearance has a different principle color relative to a principle color of the second appearance.

3. The reversible necktie of claim 1, wherein the first appearance has a different graphic pattern relative to a graphic pattern of the second appearance.

4. The reversible necktie of claim 1, further including:

an interlining layer that is disposed between the first and second fabric pieces, the interlining layer having a shape of a necktie and including a wide end, longitudinal edges and a narrow end; and a thin layer having a shape of a necktie and including a wide end, longitudinal edges and a narrow end, the thin layer having greater dimensions that the interlining layer such that when the interlining layer is superimposed on the thin layer, a peripheral area of the thin layer is formed where the interlining layer is absent over the thin layer, wherein the interlining layer is joined to the thin layer and the thin layer is joined to the first and second fabric pieces without the thin layer being attached to the first and second fabric pieces.

5. The reversible necktie of claim 4, wherein the thin layer is formed of a thin plastic mesh material.

6. The reversible necktie of claim 4, wherein the thin layer is formed of a thin paper material.

7. The reversible necktie of claim 4, wherein the peripheral area of the thin layer is an area that borders the peripheral edge of the interlining layer.

8. The reversible necktie of claim 1, wherein the first and second fabric pieces are attached to one another using stitching that is not visible along the longitudinal edges of the necktie.

9. The reversible necktie of claim 1, wherein each of the wide end and the narrow end is a pointed end.

10. The reversible necktie of claim 1, wherein a length of the first section is less than 60 percent of a length of the first fabric piece.

11. The reversible necktie of claim 1, wherein a length of the first section is greater than 50 percent of a length of the first fabric piece.

12. The reversible necktie of claim 1, wherein the seam that joins the first and second sections is not visible along the finished sides of the necktie.

13. The reversible necktie of claim 1, wherein the dimensions of the first section of the first side are substantially equal to the dimensions of the first section of the second side and the dimensions of the second section of the second side are substantially equal to the dimensions of the second section of the second side.

14. The reversible necktie of claim 1, wherein the seam between the first and second sections of the first side is displaced from and not aligned with the seam of the first and second sections of the second side.

15. A method of manufacturing a reversible necktie comprising the steps of:

providing a first fabric piece having a necktie shape and having a finished face side that has a first appearance, a wide end and a narrow end;

providing a second fabric piece having a necktie shape and having a finished face side that has a second appearance, a wide end and a narrow end;

superimposing the first fabric piece on the second fabric with the wide ends being at one end and the narrow ends at the other end and the finished face sides facing one another;

forming an interlining layer having a necktie shape having a wide end and a narrow end and a layer of second material that has a necktie shape and includes a wide end and narrow end, the layer of second material having dimensions greater than dimensions of the interlining layer;

superimposing the interlining layer on the layer of second material such that both wide ends are near one another and attaching the interlining layer to the layer of second material to form a first layered structure;

superimposing the first layered structure on the superimposed first and second fabric pieces with the layer of second material being in contact with and overlying the first fabric piece;

attaching the layer of second material to the superimposed first and second fabric pieces such that the interlining layer remains free and unattached to the first and second fabric pieces to form a second layered structure; and everting the second layered structure so that the first and second finished sides face outward;

wherein each of the first and second fabric pieces is formed of a first section that has a first appearance and a second section that has a second appearance that is visually different from the first appearance, the first and second sections being joined together along a seam, the first section of first fabric piece overlying the second section of the second fabric piece and the second section of the first fabric piece overlying the first section of the first fabric piece both in the first layered structure and the second layered structure.

16. The method of claim 15, wherein the seam between the first and second sections of the first side is displaced from and not aligned with the seam of the first and second sections of the second side.

17. A reversible necktie comprising:

first and second face layers that have matching necktie shapes, each of the face layers having a finished face side, a wide end, longitudinal edges and a narrow end, the finished face side of the first face layer being defined by a first section and a second section that are joined along a seam, the first and second sections having different fabric design patterns that provide different appearances, the finished face of the second face layer being defined by a third section and a fourth section that are joined along a seam, the third and fourth sections having different fabric design patterns that provide different appearances, the first and second face layers being superimposed in mating relationship with the finished sides thereof facing outward: wherein the first section overlies the third section and the second section overlies the fourth section, the first and fourth sections having the same fabric pattern and the second and third sections having the same fabric pattern.

18. The reversible necktie of claim 17, wherein the first section overlies the third section and the second section overlies the fourth section, the first and fourth sections having the same fabric pattern and the second and third sections having the same fabric pattern.

19. The reversible necktie of claim 17, wherein the first and third sections define the narrow ends and the second and fourth sections define the wide ends.

* * * * *